United States Patent [19]

Harris

[11] Patent Number: 4,545,576

[45] Date of Patent: Oct. 8, 1985

[54] BASEBALL-STRIKE INDICATOR AND TRAJECTORY ANALYZER AND METHOD OF USING SAME

[76] Inventor: Thomas M. Harris, 1 Lake, Irvine, Calif. 92714

[21] Appl. No.: 523,374

[22] Filed: Aug. 13, 1983

Related U.S. Application Data

[63] Continuation-in-part of Ser. No. 339,330, Jan. 15, 1982, abandoned.

[51] Int. Cl.[4] ..... A63B 71/02; A63B 71/06

[52] U.S. Cl. ..... 273/25; 364/411; 364/516; 340/323 R; 434/247

[58] Field of Search ..... 273/25, 26 R, 26 A, 273/35 R, 85 G, 87.2, 87 R, 88, 184 R, 185 R, 185 B, 185 A, 317, DIG. 28, 186 R, 186 RA; 434/247, 252, 257; 340/727, 323 R; 364/410, 411, 516

[56] References Cited

U.S. PATENT DOCUMENTS

| | | | |
|---|---|---|---|
| 3,229,975 | 1/1966 | Tompkins et al. | 273/26 A |
| 3,793,481 | 2/1974 | Ripley et al. | 273/183 R |
| 4,136,387 | 1/1979 | Sullivan et al. | 273/185 R |
| 4,137,566 | 1/1979 | Hass et al. | 273/186 RA |

*Primary Examiner*—Richard C. Pinkham
*Assistant Examiner*—MaryAnn Stoll Lastova
*Attorney, Agent, or Firm*—Francis X. LoJacono

[57] ABSTRACT

An apparatus and method to compute the trajectory of a moving object by remote, non-interfering sensors. The particular application computes the trajectory of a pitched baseball throughout its flight, including the ball's trajectory as it passes in the vicinity of a three-dimensional strike zone. The apparatus includes two pairs of video cameras, an alignment mechanism, video-storage means, a digitizer, a computer, output devices, and an operator's console. This apparatus is required to identify the ball, compute its position in three dimensions as a function of time, compute ball speed and trajectory, and present the output via computer graphics to present the viewer with essentially any desired view of the pitch.

22 Claims, 6 Drawing Figures

FIG. 6
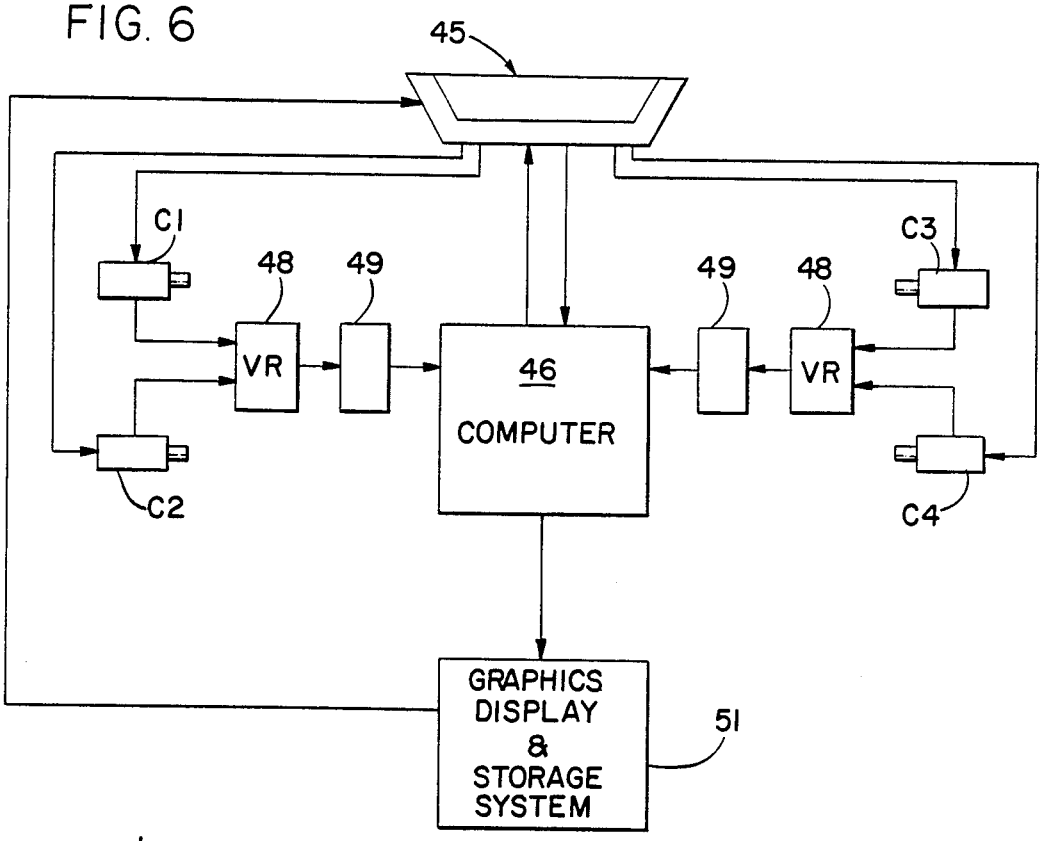
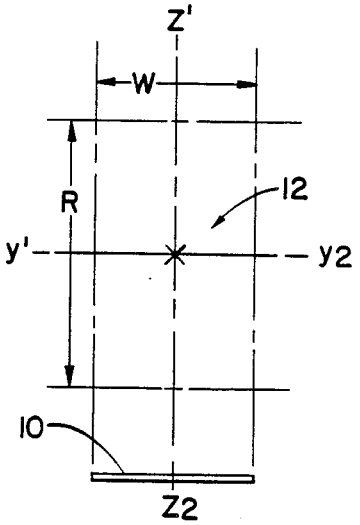
FIG. 2
FIG. 5
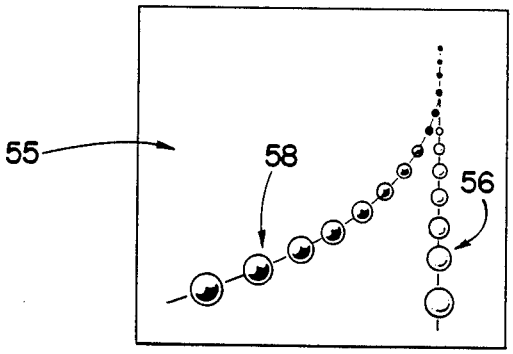
FIG. 4
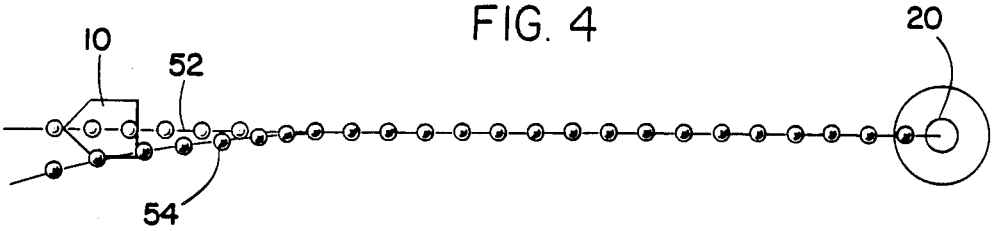

BASEBALL-STRIKE INDICATOR AND TRAJECTORY ANALYZER AND METHOD OF USING SAME

CROSS-REFERENCE

This application is a continuation-in-part of application Ser. No. 06/339,330 (now abandoned) filed Jan. 15, 1982, by the applicant, Thomas Michael Harris, and bearing the same title as the present application.

BACKGROUND OF THE INVENTION

1. Field of the Invention:

This invention relates to a system for determining the trajectory of a moving object, and more particularly to a trajectory-analyzer system and method thereof.

2. Description of the Prior Art:

There are many known devices and systems that have been employed and are presently being employed to determine the, trajectory of various high-speed objects. However, these known devices are limited in their uses, and they have features that restrict their applications to particular situations or circumstances, none of which are related to those having problems solved by the present invention.

Many pitcher-training devices have been devised but all known devices suffer from two serious drawbacks. First, they are physical objects that prevent the play of the game; and second, they only compute where the ball passes through one plane of a three-dimensional strike zone.

There are other devices, normally applied to the game of golf, that by using remote sensors could be used to track a ball; but all such known devices require that the object to be tracked be specially treated or in some other way visually be made unique. Since there is nothing visually unique about a baseball, neither the adaptation of a golf-training device nor a pitcher-training device would permit the normal play of a baseball game without any form of alteration or pre-treatment of the baseball. That the invention permits the game to be played without obstruction or tampering with the players, or any objects, makes it unique and is crucial to the success of the invention.

A further unique feature of the invention that greatly enhances its utility and clarity of presentation is the computation of a nominal trajectory (the trajectory the ball would take if the pitcher had only nominal spin on the ball). This nominal trajectory permits quantitative determination of the amount of curvature, or displacement, that the pitcher is able to impart to the ball through various types of pitches (curve ball, knuckle ball, sinker, slider, etc.).

As an example of the prior art one may refer to Linn, Jr. in U.S. Pat. No. 4,163,941, which uses television cameras in a device for measuring the velocity of the head of a golf club. This device uses the time/position relationships to establish the position of a single uniquely colored object (the head of the golf club) and to send pulses when that object is detected. Thus, Linn's system will only work in a situation in which the object to be tracked happens to have a unique color or must be pre-treated to acquire a unique color. Since in the baseball application, the objective of the present invention is to compute the trajectory of a pitched baseball without causing any interference to the game or altering any of the objects associated with it, the objectives of this invention and that of Linn are quite different. Moreover, other than using the well-known relationships that convert time to position using a video sensor, the mechanization of the systems is entirely different, and must in fact be so for the system to work.

Still another example of the prior art is disclosed in Satio et al, U.S. Pat. No. 4,005,261, which uses a scene cancellation technique through controlling voltages in a pickup tube. This device records all moving objects within the field of view, but without the ability to discriminate between these moving objects as is required, and performed, in the present invention. The computerized scene-cancellation process of the present invention is totally different in concept and design, and must be so to incorporate the logic for object identification, trajectory definition, and computer-graphics display.

SUMMARY OF THE INVENTION

In the application of employing the present invention to determine the trajectory of a pitched baseball, four basic functions must be performed: first, data must be acquired and input into a computer; second, the baseball must be identified; third, its three-dimensional trajectory must be computed; and fourth, this trajectory must be displayed to a viewer from any desired perspective (angle). Each function requires the application of specialized technology. The uniqueness of the present invention is that it combines these technologies to produce a unique capability. It is also unique in the way in which it combines the technologies, and most particularly, in the way in which it performs the function of object identification.

More specifically, the key feature of this system, which permits determining the trajectory of a baseball while the game is in normal play and without any interference or pre-treating of the ball, is a computerized scene-cancellation process presently used in airborne radars to detect low-flying aircraft against a high-clutter background. The problem is analogous in that the ball is a small white object amongst many other objects of many sizes, shapes and colors.

In the preferred embodiment, "scenes" are obtained from television cameras in the normal way, digitized in a computer-compatible format, input into a computer, put through a scene-cancellation process, and subject to additional logic to identify the ball. At that point, the well-known technique for converting the timing of video-recording-scan patterns to position is used to determine the position of the ball on each picture frame. Triangulation is then employed to determine the position of the ball in three-dimensional space. The resulting three-dimensional trajectory is then computed from the points and stored. Finally, using well-known computer-graphics techniques, the trajectory can be presented as though the viewer were positioned at any desired location so as to obtain the best "view" of the pitch (trajectory).

Therefore, the present invention has for an important objective a provision to compute and define the speed and trajectory of a projectile, such as a baseball thrown from a pitcher's mound to the point where the ball reaches the catcher located behind home plate.

It is another objective of the invention to provide a trajectory-analyzer system that includes two pairs of data-gathering units, such as video cameras—the first pair of video cameras being arranged to acquire required data on a baseball pitched to a right-handed batter, and the second pair being arranged and positioned to acquire required data on a baseball pitched to a left-handed batter. Each pair of video cameras is positioned to triangulate on the ball, once identified, so as to compute its X,Y,Z coordinates during the flight thereof, whereby the specific trajectory can be computed and then manipulated to display graphically any desired angular view of the path taken by the ball.

It is another objective of the invention to include the use of a scene-cancellation technique so that the baseball can be identified from a plethora of other objects that are in the field of view of the cameras, this process being performed without requiring the ball to possess unique features and without interrupting or interfering with the play of the game.

Still another objective of the invention is to provide an apparatus of this character that will accurately indicate each pitch, so that the exact location of the pitched ball can be readily determined; that is, it will record the exact location of the ball relative to the three-dimensional strike zone, which is determined by the dimensions of the home plate, and the distance between the batter's chest and his knees.

Another objective of the invention is to provide an analyzer of this character that includes a video-recording unit/digitizer/computer system which accepts inputs from a data-gathering unit positioning device (laser rangers/transits)—either directly or through an operator's console—and computes the position and orientation of all data-gathering units (video cameras) with respect to the X,Y,Z coordinates of the baseball diamond, specifically between the pitcher's mound and home plate.

Still a further objective of the present invention is to provide an analyzer of this type wherein a known base line is established between the respective cameras of each pair thereof, and wherein side lines of the base are defined by the position of the central axes lines of the respective cameras. Thus, by employing triangulation and other trigonometric relationships, the position of the ball as it travels between the pitcher's mound and home plate, following identification, is continuously calculated with respect to the central axis of each camera—thereby allowing the movement of the ball to be precisely located in a X,Y,Z coordinated system by the computer throughout the ball's flight, due to the known positions of the cameras and orientation of their central axes with respect to the pitcher's mound and home plate.

A further objective of the invention is to provide a system of this character that includes a graphics-display unit providing an output/view of a three-dimensional trajectory which is readily defined throughout the flight path of the ball. With the three-dimensional trajectory of the ball stored in the computer system, computer graphics can be employed to view the path of the ball from any angle at any speed.

A still further objective of the invention is to provide a complementary system of this character that includes a means for superimposing the swing of the batter as the ball passes the strike-zone area.

It is another objective of the invention to provide an analyzer that will further entertain television viewers and fans at a stadium even more by adding another dimension to viewing the game of baseball.

Still another objective of the present invention is to provide an apparatus of this type that can be used as an additional device for training and evaluating pitchers, batters and umpires alike.

The characteristics and advantages of the invention are further sufficiently referred to in connection with the accompanying drawings, which represent one embodiment. Skilled persons will understand that variations may be made without departing from the principles disclosed. I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 2 is a diagrammatic view of the X,Y,Z coordinates as related to the strike zone of a batter;

FIG. 4 is a top-plan view of a graphics display of a ball passing through the strike zone;

FIG. 5 is a graphics pictorial view of a typical "curve ball" as would be seen by a catcher; and FIG. 6 is a diagrammatic view of the basic component elements of the system.

DESCRIPTION OF THE PREFERRED EMBODIMENT

Figure 1:
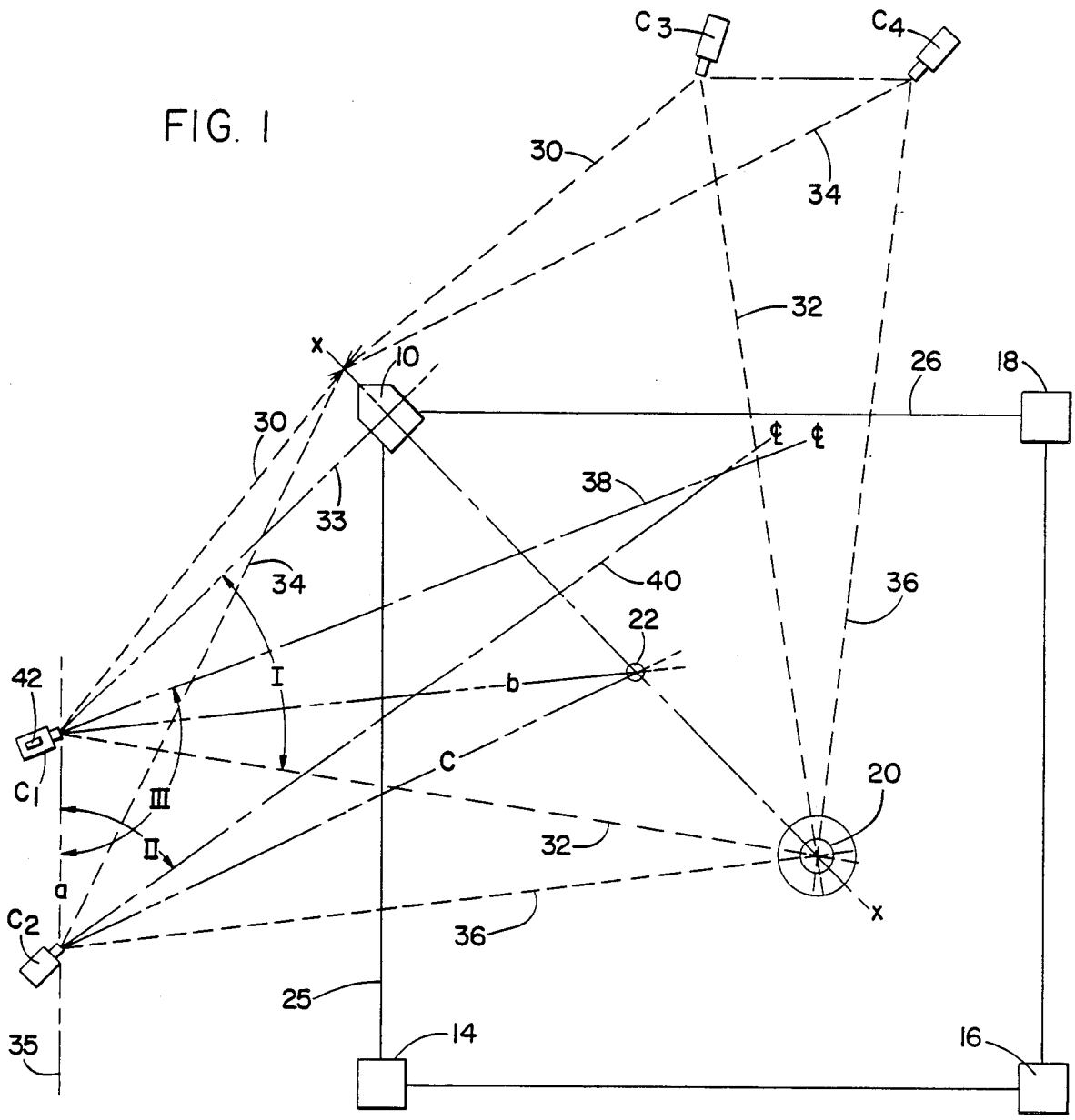
FIG. 1 is a diagrammatic view of a baseball diamond illustrating the positioning of a right and a left hand pair of data-gathering units (video cameras) with respect to the pitcher's mound and home plate.

Referring more particularly to FIG. 1, which is a diagrammatic top-plan view of a baseball diamond, there is shown a home plate 10 having the typical configuration, the width thereof defining the horizontal fixed portion of the strike zone, generally indicated at 12 in FIG. 2. Further included are first base 14, second base 16, and third base 18, the pitcher's mound 20 being interposed between home plate and second base. The center of the pitcher's mound 20 is the reference point for the start of the trajectory of the baseball 22 when thrown by a pitcher (not shown) to a catcher (not shown) located behind home plate 10. As is well known, there is established a three-dimensional strike zone 12 through which the ball must pass or intersect in order to be called a "strike". Otherwise, any ball thrown so it is out of the strike zone is called a "ball". The strike zone 12 is defined by the width of home plate indicated at W, of depth equal to the width, and the vertical area R. Hence, the width and depth of the home plate is a constant, and the vertical area is a variable, depending upon the distance between the upper chest and the knees of a given batter, as dictated by his physical dimensions and stance. Thus, it should be noted that an X coordinate is established along the imaginary longitudinal axis X—X between the home plate and the pitcher's mound. The lateral or horizontal Y axis is established to either side of the X axis; while the Z axis is defined vertically above and below the X axis. In order to provide a clearer understanding of the follwoing description, it should be noted that in FIG. 2 $Y_1$ is to the catcher's left and $Y_2$ is to the catcher's right—$Z_1$ being in the upper zone area and $Z_2$ being in the lower-zone area.

Since the objective of the invention is to compute and project grachically the trajectory of a projectile (in this case a baseball) on a television-screen, stadium-graphics display or other suitable display device, the trajectory analyzer comprises a first pair of data-gathering units of any suitable type, but preferably video cameras (C1 and C2) which are precisely located along the first-base line 25, a second pair of video cameras (C3 and C4) being positioned along the third-base line 26. Thus, when a right-handed batter is up at bat, cameras C1 and C2 are activated; and, when a left-handed batter is up at bat, cameras C3 and C4 are activated.

It is contemplated that other suitable camera locations can be established so that a clear field of vision and a large intersection angle is provided, such as for example an overhead and/or side view arrangement of the cameras.

Accordingly, in order to simplify the description of the operation of the system, the following will relate to a right-handed batter, in which case cameras C1 and C2 are employed. Therefore, it should be understood that the same operation would apply to the second pair of cameras.

As seen in FIG. 1, camera C1 is located in the proximity of home plate for a field of vision that includes home plate 10 and an area near the pitcher's mound 20. This field of vision is indicated between lines 30 and 32, whereas, camera C2 is positioned in the proximity of first base 14 for a field of vision including home plate 10 and an area near the pitcher's mound 20. The second field of vision is indicated between lines 34 and 36. The axis of the center line of C1 is indicated at 38, and the center line of C2 is indicated at 40. Thus, the two associated cameras can now be used to provide triangulation data on the ball, indicated at 22, to compute its X,Y,Z coordinates as a function of time—hence its speed and trajectory.

In setting up the system, the cameras must first be "shot", or aligned into their proper triangulated positions, to precisely determine their locations and angles (orientations) with respect to the strike zone. In order to do this, an alignment means is employed, such as a laser ranger/transit 42 mounted on C1, to measure the distance and angle of C1 to the center of home-plate line 33, to the center of the pitcher's-mound line 32, and to the associated camera C2 along base line 35. Camera C2 is also aligned with respect to its position relative to camera C1 and base line 35. Thus, after the alignments of both cameras are established, the various concurrent angles of both cameras C1 and C2 will also be established with respect to the X,Y,Z coordinates system defining the position of home plate, the pitcher's mound and the strike zone. That is, with respect to camera C1, the angle between lines 32 and 33 defines angle I, which is within the general field of vision. When in its predetermined position, camera C2 will establish angle II, which is that angle between the base line 35 and the center line 40 of C2. Angle III, which is formed between the center line 38 of camera C1 and the base line 35, is also established.

Accordingly, the application of well-known trigonometric relationships to these distances and angles will provide a basis for computing the positions of the cameras with respect to the defined X,Y,Z coordinate system and the strike zone in particular Hence, if one knows the position of the ball 22 with respect to the cameras, and the positions of the cameras with respect to the strike zone, one can then compute the position of ball 22 with respect to the strike zone as it leaves the pitcher's mound and passes relative to the strike zone.

Once the cameras are set up as described and the basic distance and angular information are fed into the system, and basic trigonometric computations performed (fixed data), the variable data is then added as each individual batter comes to bat. Thus, as shown in FIG. 6, there is provided an operator's console, indicated at 45, which is located so as to impart a full visualization of the playing field—particularly home plate and the pitcher's mound. Hence, there is now an input of all data to the computer 46, including the fixed data and the variables—such as the distance between the batter's upper chest and knees so as to compute the distance R of the strike zone, the distance changing with each batter. The right and the left sets of cameras are activated so as to correspond to a right-handed or a left-handed batter.

The complete system is controlled by an operator from the operator's console. The operator, through console controls and displays, performs such functions as:

1. Turning the system on and off.
2. Inputting all fixed data (camera positions and alignments).
3. Inputting all variable data (left or right-handed batter, key dimensions and video scenes).
4. Initiating camera action prior to each pitch.
5. Keeping track of the batter, inning, game and other "bookkeeping" functions.
6. Controlling system output.
7. Checking for proper system operation.
8. Adjusting system operation as required to keep the system operating properly.

As an example of system operation, cameras C1 and C2 are selected for a right-handed batter. When the pitcher is about to throw the ball, the operator activates the cameras, which photograph their respective scenes and stores them in their respective video-storage devices 48, such as video discs or tapes. This data is then converted into computer-compatible digital format in digital formatters 49 and input into the computer. All of this is performed automatically. The signal defining each picture element is then stored in a matrix of many cells, each cell being located at a specific address in the computer. Using the well-known relationships that relate the time at which each picture element was recorded to the position of that element with respect to the entire picture frame, the computer calculates the precise location of each picture element, within the picture frame, that is located at each address.

This process is repeated for each frame (picture) from each camera. The computer then operates on the data from succeeding frames using a scene-cancellation process, so that only moving objects are defined, specifically the baseball 22 as it leaves the pitcher's mound and travels from the right to the left of the video cameras C1 and C2, and their repsective center lines 38 and 40. Scene cancellation is the key to the system's operation, for it is this feature which allows specific objects, regardless of color, shape, etc., to be picked out of many that appear similar. This technique is applied extensively in military applications to detect aircraft that cannot be seen in any other way when their "return" on the radar scope is about the same strength as that of the background. To eliminate this "clutter", the radar maps from successive frames are cancelled one from the other, element by element, so that only differences are noted. Radar operating in this mode is called a Moving Target Indicator (MTI).

For example, a building may well yield a return of about the same strength as that of an aircraft. But since a building does not move, the signal from it emanates from the same place, or picture element, from frame to frame. Thus, when the returns from each element of one frame are subtracted from the returns of each element of the succeeding frame, the result is essentially zero for the building and all elements containing stationary objects. Hence, the radar scope would indicate no return from those positions when operating in the MTI mode. On the other hand, the return from the aircraft would not be from the same position on succeeding frames. Therefore, when the scene-cancellation process is performed, the return of the aircraft has cancelled from it the return from a field or hill, etc.; and, since these objects generally have weaker returns that those of the aircraft (although strong enough to generate clutter if the radar is not operating in the MTI mode), an object does show up at the aircraft's position.

In the present invention, initial identification of the ball is facilitated by the knowledge that the ball will first "appear" in the vicinity of the pitcher's mound; thus, only a relatively small portion of the data from each picture need be processed. Similarly, following initial identification of the ball, only a relatively small area "ahead" of the ball's last position needs to have its data processed to compute subsequent locations of the ball. This selectivity of data processed, coupled with knowledge of the ball's general speed and direction, permit the ball to be uniquely identified from other moving objects.

At this stage of the process, the ball has been identified, and its position with respect to the cameras' field of view (specifically, the center lines) has been defined. Since the computer system has previously stored the positioning and alignment data on the two cameras C1 and C2, it can then triangulate to determine the position of the ball at each point along its trajectory. The number of points along the trajectory is a direct function of camera speed (frame rate) and the speed of the ball, but for nominal conditions is on the order of 20 to 30.

Figure 3:
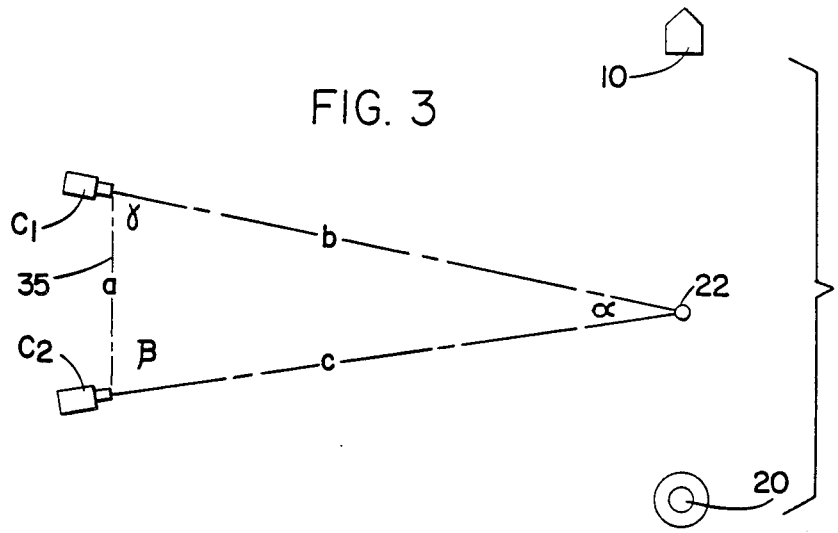
FIG. 3 is a diagrammatic view showing the triangulation of a pair of cameras and a moving baseball, whereby the position of the ball is computed with respect to the cameras.

Since the length of side "a" (base line 35 illustrated in FIGS. 1 and 3) is measured and known, the angles of the cameras' center lines are also measured and known relative to each other; and since the angles from the cameras' center lines to the ball 22 are computed and known, the angles $\gamma$ and $\beta$ can be readily calculated. Thus, since the sum of $\alpha$ plus $\gamma$ plus $\beta$ equals 180°, the angle $\alpha$ can be computed as the ball moves relative to the center lines 38 and 40. Finally, from the law of Sines, in which $a/\sin\alpha = b/\sin\beta = c/\sin\gamma$, the length of sides "b" and "c" are readily computed. Hence, the position of the ball with respect to C1 and C2 is precisely computed.

As already described, the positions of the cameras with respect to home plate and the pitcher's mound, and particularly to the strike zone, have been computed. Also, since computations are made for the complete flight of the ball 22, a three-dimensional trajectory of the ball with respect to the strike zone can be completely and precisely defined.

With the three-dimensional trajectory of the ball stored in the computer system, computer-graphics software, programmed in the computer 46, will operate on the trajectory in order that computer graphics are generated for display or storage on appropriate mediums in the graphics-display/storage system 51. To provide a three-dimensional micro-computer graphics, one can employ a 6502 Apple II Assembly Language No. A2-3D2. This system will be used to assist in monitoring the system's operation and to "view"—from any angle at any speed—the trajectory of the ball between the pitcher's mound and home plate. As an example, one could visualize the ball from behind home plate as the catcher would, as indicated in FIG. 5.

This operation is performed using well-known techniques for working with three-dimensional objects and being able to manipulate them so as to present the best "view" for the desired purpose. In the present circustance, the A2-3D2 Graphics Package is being used to achieve this objective. The process is fully described in the documentation which comprises part of the Graphics Package. In brief, the system defines an "eye" which is located at the desired viewing position and is oriented such that, in this case, the ball's trajectory is seen from the desired angle. For example, to obtain the top view presented in FIG. 4, the operator uses the X, Y and Z keys of a typewriter-like input terminal to move the "eye" to the desired location. Say, for example, that in FIG. 4 the trajectory is being viewed from fifty feet above the ground, half way between the pitcher's mound and home plate. Further, assume that the X,Y,Z coordinate system is set up so that the origin is at the center of home plate, the positive X-axis extends from home plate to cross the pitcher's mound and second base, the positive Z-axis extends vertically upward, and the Y-axis is orthogonal to both, extending to the right when viewed in the direction of the positive X-axis. In this example, the system operator would toggle the Z key until the "eye" was fifty feet high ($Z=+50$), would toggle the X key until the "eye" was moved half way between the pitcher's mound and home plate ($X=+30$), then toggle the Y key until the "eye" lay on the X-axis ($Y=0$). With the "eye" thusly properly positioned, the operator would then orient it so that it was "looking" in the right direction. In the A2-3D2 system the P, B and Y keys are used to rotate the "eye" in pitch, bank and yaw, respectively. Thus, in our example, the operator would toggle the P key until the "eye" is looking straight down and toggle the R key until the trajectory is oriented as desired on the display unit. Since pitch is at −90° (straight down), the Y key (yaw) would not be needed to properly orient the picture. In the A2-3D2 system this takes, quite awile to do. In the operational system, preset views, such as the ones presented in FIGS. 4 and 5, would be set up so that one key stroke would set the "eye" for the desired viewing angle.

Since the trajectory of the ball is defined by a series (a time history) of X,Y,Z positions, the speed of presentation—or how fast the ball moves from the pitcher's mound to home plate—is determined by the rate at which succeeding X,Y,Z coordinates are called up. This feature is completely flexible, permitting the speed to vary from real-time (move as fast as the ball actually moved) to essentially as slow as a viewer would like it. Typically, the range of speeds for slow-motion presentation varies from one-sixth to one-thirtieth normal speed. The speed of the ball at any point in its trajectory is determined by multiplying the distance traversed between frames by the cameraframe rate.

In addition, various other means can be provided within the system whereby the computer could also generate a nominal trajectory which would be simultaneously displayed along with the actual trajectory of the baseball. For example, the nominal trajectory 52 shown in FIG. 4 is the flight path the ball 22 would follow if the pitcher had "nothing on it"; and it would be computed from knowledge of the ball's speed and flight path immediately after it left the pitcher's hand—prior to the time the ball begins to curve significantly. This information would be coupled with basic ballistics to compute the nominal trajectory. Both the actual trajectory 54 and the nominal trajectory 52 can be simultaneously illustrated for comparison.

As an additional example, FIG. 5 illustrates an end-view perspective of a typical "curve-ball" trajectory as viewed by a catcher. More specifically, in this pitch the ball would first appear to the viewer's right at the top of the screen 55. As the ball leaves the pitcher's mound and approaches the strike zone, it grows in size. In this presentation, the nominal trajectory is shown by open circles 56; while the actual trajectory is shown in darkened circles 58. From analyses of pictures such as these, played at whatever speed suitable, much can be learned about how effective a pitcher was, and exactly what kind of control he had on the ball's flight. It is contemplated that an indication, such as flashing of the ball, or a change of color, will be given when the ball reaches the strike zone. A readout of current speed could also be provided.

Not only is the viewer provided with the precise indication as to whether the pitch was a "strike" or a "ball", and exactly what part of the strike zone the ball crosses (assuming a "strike"), but the system will also provide simultaneous viewing of the batter's swing with respect to the ball as it passes home plate.

The batter's swing is computed using the same principles as those used to compute the ball's trajectory. Specifically, using scene-cancellation and knowledge of the section of the cameras' field of view that the motion of interest will occur, the computer will be programmed to "look" for motion and, having detected it, to keep track of successive X,Y,Z positions of enough portions of the bat (say at the end, and where the batter is holding it) in order to determine the bat's position and alignment as the function of time. This can be done simultaneously with computation of the ball's trajectory, since all objects within the cameras' fields of view are being stored (including the bat); and thus software analogous to that used in computing the ball's trajectory can be used to compute the bat's trajectory. Since these X,Y,Z trajectories are a function of time, and are known precisely with respect to a common reference time, their (the ball and the bat) timing with respect to each other is known and can thusly be displayed.

It must be understood that, while the processes of data gathering, data storage, digitizing, scene cancellation, ball identification, ball positioning, trajectory definition, and computer-graphics display are all essential features of the apparatus, they do not need to be performed in exactly the manner as previously described. Specifically, some functions are best performed while the data is in video format, while other functions are best performed with the data in digital format. The comparison of successive frames of data in order to detect moving objects is one such function which could be performed as well, or possibly better, while still in video format. The Measuronics Corporation (4241 2nd Avenue North, Great Falls, Mont.) has vision-computing technology, suitable for application in the present system, that does in fact subtract successive images to detect change while the data is still in video format.

The invention and its attendant advantages will be understood from the foregoing description. It will be apparent that various changes may be made in the form, construction and arrangement of the parts of the invention without departing from the spirit and scope thereof or sacrificing its material advantages, the arrangement hereinbefore described being merely by way of example. I do not wish to be restricted to the specific form shown or uses mentioned, except as defined in the accompanying claims.

I claim:

1. A baseball-strike-indicator-and-trajectory-analyzer apparatus adapted to be associated with a baseball diamond, including the pitcher's mound and home plate, comprising:

at least one pair of sensors positioned with respect to said baseball diamond, wherein each of said sensors has a field of vision that includes said pitcher's mound, a batter, and said home plate, whereby a ball moving between said pitcher's mound and said home plate is continuously within the field of view;

means connected to said sensors to record and store information, relating to all objects including said ball, received from said sensors;

means connected to said recording and storing means to convert said information to a computer-compatible digital format;

computer means adapted to receive and analyze said information in digital form from said digital-converter means;

means to distiguish said ball from all other objects sensed by said sensors, so that said ball can be recognized and its trajectory defined in time and three-dimensional space;

means adapted to analyze the initial part of said ball's trajectory in order to compute a nominal trajectory;

means to determine said batter's dimensions when in his batting stance;

means to compute the strike zone for said batter;

graphics display and storage means adapted to receive computed information from said computer means to display graphically the movement of said ball in various selective pictorial arrangements; and means for controlling said apparatus.

2. An apparatus as recited in claim 1, wherein said sensors include a first pair of video cameras positioned to view said pitcher's mound and said home plate from the right side of said baseball diamond, and a second pair of video cameras positioned to view said pitcher's mound and said home plate from the left side of said baseball diamond.

3. An apparatus as recited in claim 2, wherein a first video camera of each of said pairs is located in the proximity of said home plate, and the second video camera of each of said pairs is located in the proximity of first and third bases; and wherein each of said cameras includes a center-axis line.

4. An apparatus as recited in claim 3, including means for arranging and aligning said cameras in their respective positions relative to each other, said pitcher's mound and said home plate, so that the position and alignment of said cameras with respect to each other and the baseball diamond can be precisely measured.

5. An apparatus as recited in claim 4, wherein the position and orientation of said video cameras of each of said pairs are measured relative to each other using said arranging and alignment means, the known distances and angles between said associated video cameras defining a framework for triangulation computations of any object, including said baseball, within the field of vision of said cameras.

6. An apparatus as recited in claim 5, wherein each of said video cameras is located at known positions relative to each other, the position and orientation of said first camera being determined relative to said home plate and from the center of said pitcher's mound, using said arranging and aligning means to determine the position and orientation of said cameras with respect to said baseball diamond.

7. An apparatus as recited in claim 6, including video-storage means wherein all data obtained from said cameras is stored.

8. An apparatus as recited in claim 7, including means to compare frame-to-frame data while said data is still in video format, in order to identify moving objects and stationary objects, the resulting data then being put into computer-compatible digital format and input into a computer.

9. An apparatus as recited in claim 7, including means for digitizing all of said stored video data in order to put said video data into a computer-compatible format, and input means to store said video data into said computer so that each cell of each picture frame displayed by each of said video cameras is stored in a known addressable portion of said computer's memory.

10. An apparatus as recited in claim 9, wherein a three-dimensional strike zone having X,Y,Z coordinates is defined by said home plate and the physical dimensions of said batter.

11. An apparatus as recited in claim 9, including means to compare successive cell-by-cell frames from each of said video cameras within the computer, so that moving objects are identified and their location within the computer's memory is known.

12. An apparatus as recited in claim 11, including logic means to identify said moving ball as it leaves the vicinity of the pitcher's mound and continues to be identified in each of said successive frames throughout the flight of said ball.

13. An apparatus as described in claim 12, including means to determine the position of said ball with respect to each of said picture frames for each of said cameras.

14. An apparatus as described in claim 13, including triangulation means to determine the position of said ball for each of said frames with respect to the position of said cameras.

15. An apparatus as described in claim 14, including means to define said X,Y,Z coordinates of said ball relative to said baseball diamond and said strike zone for each of said frames.

16. An apparatus as described in claim 15, including means to produce said X,Y,Z trajectory of said ball as a function of time, hence defining position and speed as a function of time.

17. An apparatus as described in claim 15, including means to compute a nominal-theoretical trajectory of said ball as it would travel between said pitcher's mound and said home plate.

18. A method to indicate and analyze the trajectory of a baseball between the pitcher's mound and home plate associated with a baseball diamond, comprising the steps of:

providing sensors defined by a first and a second video camera;

positioning said first and second cameras so as to establish a field of vision to include said pitcher's mound and said home plate therein;

establishing a base line with respect to said first and second cameras by measuring the distance between said cameras;

establishing the axis of the center line for each camera with respect to its associated field of vision;

determining the angle between said base line and said center line of each of said cameras;

determining the angle between said first camera and the center of said home plate, and said first camera and the center of said pitcher's mound;

defining a strike zone, with respect to said home plate, having an X, Y, Z coordinate system, whereby "balls" and "strikes" are determined;

storing data acquired by said cameras;

converting said data to a computer-compatible digital format;

inputing said digital format to a computer;

computing known and variable data in order to identify said baseball and compute its trajectory between said pitcher's mound and said home plate;

displaying the resulting information;

recording and storing said data from said video cameras, prior to computing said data, by means of a video recorder; and providing means for controlling the input to a computer in which said data is computed;

said input being defined by said known data and said variable data, said variable data being the data that is established by the movement of said baseball as said baseball traverses said strike zone.

19. A method as recited in claim 18, wherein said step of providing a controlling means includes the step of initiating camera operation prior to each pitch of a baseball from said pitcher's mound.

20. A method as recited in claim 19, including the step of providing a means to digitize the information from said video recorder into a computer-compatible format prior to being received by said computer.

21. A method as recited in claim 20, including the step of programming graphics software within said computer.

22. A method as recited in claim 21, wherein said displaying of said resulting computed information is graphically illustrated in various selective forms and dimensions.

* * * * *